United States Patent [19]

Stinnett

[11] 4,447,761

[45] May 8, 1984

[54] NEGATIVE ION GENERATOR

[75] Inventor: Regan W. Stinnett, Albuquerque, N. Mex.

[73] Assignee: The United States of America as represented by the United States Department of Energy, Washington, D.C.

[21] Appl. No.: 347,760

[22] Filed: Feb. 11, 1982

[51] Int. Cl.[3] ..... H01J 27/02

[52] U.S. Cl. ..... 315/111.81; 250/423 R; 250/424; 313/304

[58] Field of Search ..... 315/111.8; 250/423 R, 250/424; 313/409, 302, 303, 304

[56] References Cited

U.S. PATENT DOCUMENTS 4,045,677 8/1977 Humphries, Jr. et al. ..... 250/423 R
4,298,798 11/1981 Huffman ..... 250/423 R

OTHER PUBLICATIONS

Keller et al., "High-Current Low-Divergence Ion Beam from a Concave Multiple-Aperture Source Electrode," Sep. 1975, *IBM Technical Disclosure Bulletin,* vol. 18, No. 4, pp. 1057–1058.

"Negative Ion Losses in Magnetically Insulated Vacuum Gaps," Van Devender et al., *Appl. Phys. Lett.* 38 (4), Feb. 1981.

"Negative Ion Production in Magnetically Insulated Transmission Lines," Stinnett et al., *Bull. Am. Phys. Soc.,* 26, 1099, Abstract 9E8, Oct. 1981.

*Primary Examiner*—Eugene R. LaRoche
*Assistant Examiner*—Vincent DeLuca
*Attorney, Agent, or Firm*—George H. Libman; Albert Sopp; Michael F. Esposito

[57] ABSTRACT

A negative ion generator is formed from a magnetically insulated transmission line having a coating of graphite on the cathode for producing negative ions and a plurality of apertures on the opposed anode for the release of negative ions. Magnetic insulation keeps electrons from flowing from the cathode to the anode. A transverse magnetic field removes electrons which do escape through the apertures from the trajectory of the negative ions.

10 Claims, 8 Drawing Figures

NEGATIVE ION GENERATOR

The United States Government has rights in this invention pursuant to Contract No. DE-AC04-76DP00789 between the Department of Energy and Sandia Corporation.

BACKGROUND OF THE INVENTION

The present invention relates generally to negative ion generators, and more particularly to a negative ion generator utilizing a magnetically insulated transmission line.

The magnetic confinement fusion program is currently searching for good techniques to heat magnetically confined plasmas to the 10 keV temperatures required for fusion. Ohmic heating is only sufficient to reach temperatures of a few keV because of the $T^{-3/2}$ scaling of plasma resistivity. The leading candidate for bridging the gap between temperatures achievable by Ohmic heating and 10 keV has been neutral beam heating. This heating method uses energetic neutrals, usually 60–120 keV hydrogen or deuterium, to deposit energy in the plasma. The energy deposition length in the plasma scales with neutral beam energy. Future generations of tokamaks which simulate reactor conditions will have dimensions and densities so large that currently available neutral beams will only produce skin heating. The 300 to 2000 keV neutral beam energies that are necessary to heat these machines efficiently cannot be achieved using the present technique of converting positive ion beams to neutral beams in charge exchange cells, because the efficiency of these cells decreases exponentially with increasing beam energy. The efficiency of present neutral beam systems is already marginal at 170 keV.

It has been previously recognized that a possible solution to this problems lies in the production of negative ion beams, as these beams can be neutralized with high efficiency.

L. R. Grisham, et. al., suggest in "Plasma Heating with Multi-MeV Neutral Impurity Beams," *Princeton Plasma Physics Lab. Report PPPL*-1759, March 1981, the use of negative ions with atomic weights of 6 to 20, such as lithium, carbon and oxygen, at energies of up to 1 MeV per AMU. However, the highest output achieved by large area negative ion sources is only one ampere at 0.01 amp per centimeter square at a beam energy of 40 keV. Small area discharge sources have produced intensities of several amps per centimeter square, but only with total current less than 1 ampere and at beam energies less than 60 keV.

SUMMARY OF THE INVENTION

It is an object of this invention to provide a high energy negative ion beam.

It is another object of this invention to provide a single stage generator of large quantities of high energy negative ions.

It is also an object of this invention to provide a generator of negative ions utilizing a magnetically insulated transmission line.

It is a further object of this invention to provide a source of negative ions distributed over an area.

Additional objects, advantages and novel features of the invention will become apparent to those skilled in the art upon examination of the following description or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, the negative ion generator of this invention may comprise a magnetically insulated transmission line having at least one hole in the cathode to permit negative ions to escape the transmission line, and a device for removing electrons from the negative ion flow.

BRIEF DESCRIPTION OF THE DRAWINGS

The accompanying drawings, which are incorporated in and form a part of the specification, illustrate an embodiment of the present invention and, together with the description, serve to explain the principles of the invention.

DETAILED DESCRIPTION OF THE INVENTION

Figure 1:
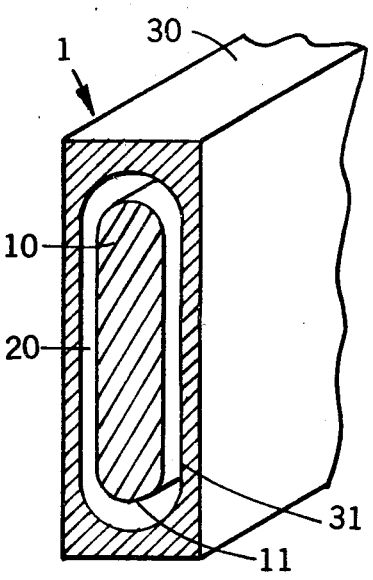
Fig. 1 (Prior Art)
FIG. 1 is a sectional view of a magnetically insulated transmission line.

FIG. 1 shows a section of magnetically insulated transmission line (MITL) 1 including cathode 10 surrounded by anode 30 to form a triplate configuration. A narrow vacuum gap 20 exists between cathode 10 and anode 30.

MITL's are used to transmit power from a source to a load in multiterawatt accelerators for radiation effects simulation and particle beam fusion. These transmission lines achieve power densities as high at $10^{13}$ watts per square centimeter and operate at electric stress levels up to $10^9$ volts per meter. This operation is possible because electrons emitted from the MITL cathode are prevented from crossing the vacuum gap between the cathode and anode by a transverse magnetic field arising from self-current flowing in the MITL. This magnetic field is strong enough to cause the electrons to move in cycloidal orbits which do not reach the anode, thereby preventing power loss caused by arcing and electron flow to the anode. Magnetically insulated power flow has been demonstrated at voltages ranging from 0.1 to 10 MeV.

When the electric field on the cathode is greater than approximately $2.5\times10^7$ volts per meter, a cathode plasma is formed by explosive emission. The constituents of this cathode plasma are believed to include both electrode material and hydrocarbon contaminants on the cathode surface. It is believed that backscattering of cathode plasma ions from the cathode surface is the dominant mechanism for production of negative ions in MITL's. For this reason it is important that the cathode of a negative ion generator be coated with a material which forms stable negative ions. Examples of such material are hydrogen, lithium, carbon and oxygen.

Figure 2:
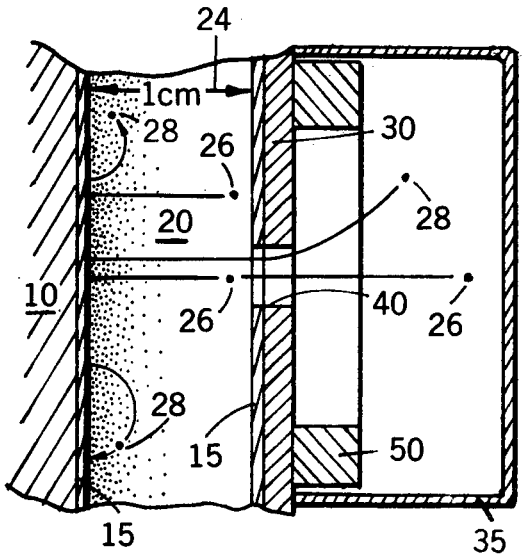
FIG. 2 is an enlarged view of a portion of FIG. 1 which has been modified to include a basic embodiment of the invention.

FIG. 2 shows a portion of a seven meter long, magnetically insulated, triplate transmission line having a spacing of 1 centimeter between the anode 30 and cathode 10. Each surface of anode 30 and cathode 10 facing 1 cm gap 20 is covered with a 25 micron graphite coating to ensure the creation of a uniform cathode plasma. When the transmission line is energized with a 2 MV, 400 kA pulse lasting 80 ns, plasma 24 forms near the cathode having an electron density which is believed to vary from approximately $10^{24}$ $m^{-3}$ near the cathode to $10^{20}$ $m^{-3}$ near the edge of the plasma sheath. Negative ions 26 from cathode 10 are propelled toward anode 30. In accordance with this invention, aperture 40 is provided in anode 30 for the passage of negative ions 26. In addition, means are provided for deflecting any electrons 28 which pass through aperture 40 before magnetic insulation is established or which are created by secondary emission when negative ions strike the edge of aperture 40. As illustrated, these means are magnet 50 for creating a transverse magnetic field behind the exterior surface of anode 30. The relatively heavy negative ions are not affected by the magnetic field and proceed with their course practically unaltered. However, the much lighter electrons are deflected by the magnetic field and are steered away from the course of the negative ions. In this manner, a negative ion generator is provided.

It has been found that the diameter of round aperture 40 may be as large as 60% of the spacing between the cathode and anode although better collimation is obtained with a diameter of approximately 20% of the spacing. It is believed that other aperture shapes, such as a slot aligned with the direction of current flow, may also be used as long as the area of the aperture does not become large enough to cause a loss of magnetic insulation.

Since the presence of aperture 40 would cause the loss of vacuum in gap 20, the negative ion receiving volume outside anode 30 is evacuated within air-tight wall 35. For convenience, wall 35 is not shown in the other embodiments disclosed herein. However, it is to be understood that the contemplated uses of neutralized negative ions are within evacuated enclosures.

Figure 3A:
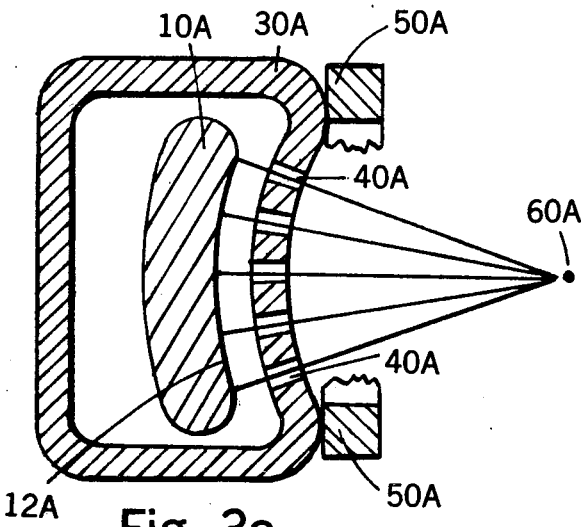
FIG. 3A is a sectional view of a second embodiment of the invention.

FIG. 3A shows an embodiment of a negative ion generator for providing a line focus of negative ions. As shown in cross-section in FIG. 3A, cathode 10A has concave surface 12A closely spaced from a conforming surface of anode 30A which has a number of apertures 40A distributed thereon. The axis of each aperture 40A is arranged so that negative ions passing therethrough will be directed to a point along a line 60A parallel to the axis of the MITL. A magnet 50A is provided along the outer surface of anode 30A to deflect electrons from the line of ions.

Figure 3B:
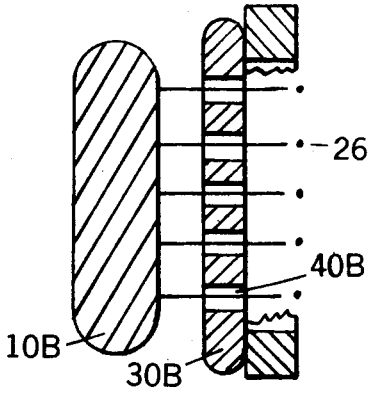
FIG. 3B is a sectional view of a third embodiment of the invention.

FIG. 3*b* shows a modification of the embodiment of FIG. 3*a* wherein the facing surfaces of cathode 10B and anode 30B form parallel planes. The plurality of apertures 40B allows the passage of a burst of negative ions 26B distributed over an area. This embodiment also illustrates a system designed specifically for negative ion production in that magnetic insulation only occurs between the facing cathode and anode where ions are being generated. The remaining surfaces of the cathode are spaced sufficiently (approximately 1 meter) from other conducting surfaces to prevent arcing. This arrangement maximizes the efficiency of the MITL as a negative ion source.

Figure 3C:
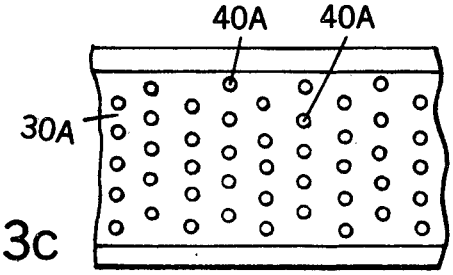
FIG. 3C is a plan view of the embodiments of FIGS. 3A and 3B.

FIG. 3*c* shows a facing view of the anode for either of the embodiments of FIGS. 3*a* or 3*b*. It is understood that any pattern of apertures may be used in anode 30. It is also contemplated that a mesh arrangement may be used to provide a plurality of apertures in a conducting anode.

Figure 4:
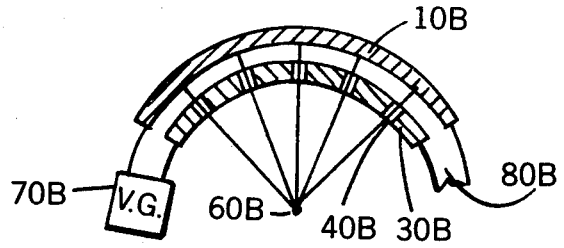
FIG. 4 is a longitudinal sectional view of another embodiment of the invention.

FIG. 4 shows voltage generator 70B connected across anode 30B and cathode 10B. A load 80B dissipates the power at the end of the MITL. In this arrangement, a cross-section of the MITL is identical to that of FIG. 3*a*; however, the MITL has been curved along its length to focus all ions passing through apertures 40C in anode 30C to a single point 60C. This arrangement would be especially useful in providing a negative ion beam for use in tokamaks.

Figure 5:
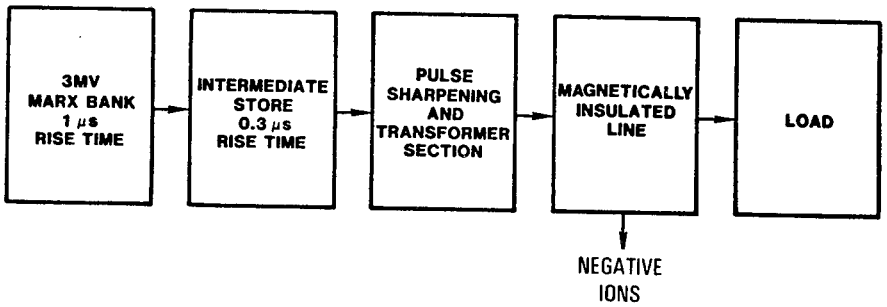
FIG. 5 is a schematic diagram of a MITL.

FIG. 5 shows schematically a voltage generator which may be used to pulse a MITL. It includes a 3 megavolt Marx bank capacitor having a 1 microsecond rise time, an intermediate storage capacitor having a 0.3 microsecond rise time, and a triggered gas switch for controlling the flow of current into a pulse forming line, a transformer line, and finally the MITL. A description of one such device may be found in an article by J. P. VanDevender, "Long Self-Magnetically Insulated Power Transport Experiments," J. Appl. Phys. 50(6), June 1979.

Figure 6:
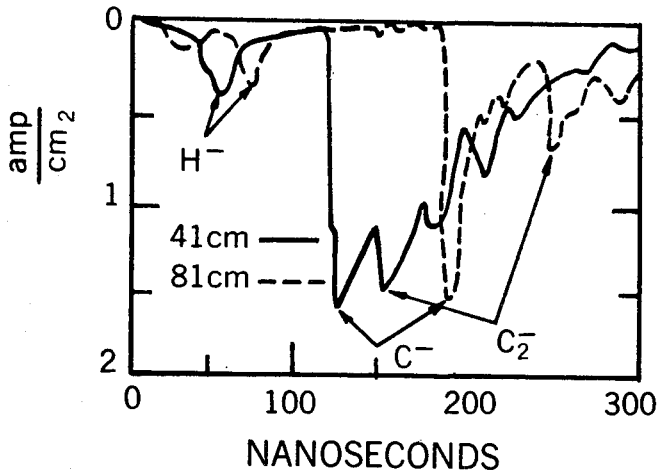
FIG. 6 is a representation of collected ions.

FIG. 6 is a graphical representation of the output of negative ion collectors mounted 41 and 81 centimeters, respectively, along the flight path of a negative ion generator. The first collector is a 4 cm diameter, 50% transmitting wire mesh. The second collector is a 4 cm diameter solid metal disk. Both collectors are biased at +300 V. The measured spikes at the collectors are consistent with the calculated time of arrival of light H− ions and heavier C− and C−2 ions, thereby reflecting the voltage between the anode and the cathode during the pulse and indicating that negative ions are produced by this invention. Additional experiments using a Thompson parabola confirm the production of negative ions.

Several interesting effects have been observed during experiments on the negative ion generator. The negative ion intensity is strongly dependent on cathode surface condition. Intensities of over 30 $A/cm^2$ were produced when the cathode had a new carbon coating. Subsequent shots taken without a new coating showed a steadily decreasing intensity until an equilibrium value of 3 $A/cm^2$ was reached. The experiments also indicated that negative ion intensity was enhanced near a hole in the anode. This result indicates that MITL's with partially transparent mesh anodes should make intense negative ion sources.

Magnetically insulated electron flow is intrinsically a pulse technique. The pulse length is limited by gap closure to less than a few hundred nanoseconds. It is possible, nevertheless, to obtain large time average powers from pulsed power devices by repetitive pulsing. Pulsed power systems exclusive of the electron or ion beam diodes have been developed to operate continuously at 1.5 MV, 5 kJ, 20 Hz, and 100 kW in transformer systems and at 250 kV, 5 kJ, 50 Hz, and 250 kW in Marx systems operated in a 5 second burst mode. Although substantial development will be required before multimegawatt systems become operational, it appears that extensions of present day technology could reasonably lead to such systems.

A presently planned MITL under development should produce an output of 4 MV, 433 kJ Marx energy, and 150 kJ MITL energy. Coupled to a 2.5 $m^2$ parallel plate MITL, this system would probably produce a 4 MeV beam of $C^-$, $O^-_2$ ions with a total energy of 53 kJ per pulse, assuming a negative ion current density of 20 A/cm squared and a 67% transparent anode. By shaping the anode and cathode of the MITL to focus the beam, as described above, this system could produce a small cross-section beam for access into a fusion reactor. The beam energy would range from 0.17 to 0.33 MeV-/AMU, a good range for heating large tokamaks.

Pulse negative ion sources may have a significant advantage over continuous sources in neutralization efficiency if they can use photodetachment to neutralize the beam. Photodetachment cross sections for negative ions are large ($10^{-17}$ $cm^2$) in the infrared, visible and UV range of photon energy. Since pulsed sources compress the negative ion beam to bursts with relatively high particle density ($10^{12}$ $cm^{-3}$), the mean free path of a photon in the burst is about $10^3$ meters. If the beam is 1 meter wide and a 10 pass system is assumed, photodetachment neutralization efficiency of over 80% might be achieved with a pulsed light source which provided 10 to 50 joules over the 100 to 500 nanosecond beam duration. The use of photodetachment would eliminate the need for elaborate pumping systems involved with gas stripping cells and would greatly reduce the problems associated with absorbing the energy from the unneutralized portion of the beam.

The particular sizes and equipment discussed above are cited merely to illustrate particular embodiments of the invention. It is contemplated that the use of this invention may involve components having different sensitivities and sizes as long as the principle, providing apertures in the anode of an MITL for the passage of negative ions created at a cathode having the proper surface coating, is followed. A generator so constructed will provide a useful source of high energy negative ions which may be used as in or converted to neutral beams for other applications. It is intended that the scope of the invention be defined by the claims appended hereto.

I claim:

1. A negative ion generator comprising:

a magnetically insulated transmission line including an elongate cathode having an emitting surface facing an elongate anode across a gap, said emitting surface having coating means for producing negative ions, and said anode having aperture means for the passage of negative ions; and magnetic means for deflecting electrons which pass through said aperture without significantly effecting the flight of negative ions.

2. The negative ion generator of claim 1 wherein the emitting surface of said cathode conforms to the facing surface of said anode.

3. The negative ion generator of claim 2 wherein said aperture means comprises a plurality of apertures distributed along said anode.

4. The negative ion generator of claim 3 wherein said emitting surface and said facing surface are parallel planes.

5. The negative ion generator of claim 3 wherein said emitting surface is concave.

6. The negative ion generator of claim 5 wherein the elongate axis of said cathode is straight, the negative ions being focused onto a line.

7. The negative ion generator of claim 5 wherein the elongate axis of said cathode is arcuate, the negative ions being focused onto a point.

8. The negative ion generator of claim 1 wherein said coating means comprises graphite.

9. The negative ion generator of claim 1 further including a high voltage pulse generator connected at one end of said transmission line and a load connected to the other end of said line.

10. The negative ion generator of claim 1 wherein said aperture means comprises at least one round aperture having a diameter of approximately 20% of the gap spacing.

* * * * *